US008393174B2

(12) United States Patent
Ghanimian

(10) Patent No.: US 8,393,174 B2
(45) Date of Patent: Mar. 12, 2013

(54) JEWELRY SETTING

(76) Inventor: Simon Ghanimian, Glendale, CA (US)

( * ) Notice: Subject to any disclaimer, the term of this patent is extended or adjusted under 35 U.S.C. 154(b) by 411 days.

(21) Appl. No.: 12/435,376

(22) Filed: May 4, 2009

(65) Prior Publication Data

US 2010/0275652 A1 Nov. 4, 2010

(51) Int. Cl.
*A44C 17/02* (2006.01)

(52) U.S. Cl. ..... 63/28; 63/26

(58) Field of Classification Search ..... 63/26–28, 63/12–13, 3, 15; D11/91–92; 29/10
See application file for complete search history.

(56) References Cited

U.S. PATENT DOCUMENTS

| | | | | | |
|---|---|---|---|---|---|
| 233,678 | A | | 10/1880 | Hessels | |
| 816,997 | A | * | 4/1906 | Pollard | 63/26 |
| 843,006 | A | * | 2/1907 | Dover | 63/28 |
| 881,065 | A | * | 3/1908 | Fishel | 63/28 |
| 884,979 | A | * | 4/1908 | Fishel | 63/28 |
| 1,192,092 | A | * | 7/1916 | Morse | 63/28 |
| 1,421,339 | A | * | 6/1922 | Zalowitz | 63/28 |
| 1,449,158 | A | * | 3/1923 | Wittstein | 63/27 |
| D69,678 | S | * | 3/1926 | Sturm | D11/90 |
| D80,898 | S | * | 4/1930 | Kaufman | D11/92 |
| 2,132,905 | A | * | 10/1938 | Maynier | 63/29.1 |
| D152,068 | S | * | 12/1948 | Donchi | D11/90 |
| 3,014,354 | A | * | 12/1961 | McCary | 63/27 |
| 3,605,442 | A | * | 9/1971 | Parker | 63/15 |
| 4,748,728 | A | * | 6/1988 | Magnien et al. | 29/10 |
| 4,819,453 | A | * | 4/1989 | McNamara | 63/28 |
| 4,835,987 | A | * | 6/1989 | Magnien et al. | 63/28 |
| 4,878,364 | A | * | 11/1989 | Freilich | 63/28 |
| 5,020,338 | A | * | 6/1991 | Payne et al. | 63/12 |
| 5,076,072 | A | * | 12/1991 | Payne | 63/12 |
| 5,099,660 | A | * | 3/1992 | Dostourian | 63/28 |
| 5,123,265 | A | | 6/1992 | Ramot | |
| 5,377,506 | A | * | 1/1995 | Tranzer | 63/28 |
| 5,419,159 | A | * | 5/1995 | Muller | 63/28 |
| 5,671,613 | A | * | 9/1997 | Hoover et al. | 63/27 |
| 5,848,539 | A | | 12/1998 | Ouzounian | |
| 5,992,177 | A | * | 11/1999 | Beard | 63/29.1 |
| 6,026,660 | A | * | 2/2000 | Lai | 63/26 |
| D430,061 | S | * | 8/2000 | Chan | D11/92 |
| 6,112,552 | A | * | 9/2000 | Hoffman | 63/26 |
| D439,191 | S | * | 3/2001 | Wolf | D11/26 |
| 6,393,680 | B1 | * | 5/2002 | Chan | 29/10 |
| D458,868 | S | * | 6/2002 | Cheung et al. | D11/91 |
| 6,442,971 | B1 | * | 9/2002 | Gurevich | 63/28 |
| 6,453,700 | B1 | * | 9/2002 | Avril | 63/26 |
| 6,532,765 | B1 | | 3/2003 | Hurwitz | |
| 6,591,633 | B2 | * | 7/2003 | Pachauer | 63/26 |
| D488,088 | S | * | 4/2004 | Vartanian | D11/91 |
| D506,158 | S | * | 6/2005 | McMullan et al. | D11/91 |
| D534,095 | S | * | 12/2006 | Lai | D11/92 |
| 7,198,091 | B2 | * | 4/2007 | Yakubovich | 164/35 |
| D558,637 | S | * | 1/2008 | Riesenberg et al. | D11/91 |
| 2002/0178750 | A1 | * | 12/2002 | Pinto | 63/26 |
| 2003/0046955 | A1 | * | 3/2003 | Elishyov | 63/26 |
| 2004/0040343 | A1 | * | 3/2004 | Mino et al. | 63/27 |
| 2008/0209943 | A1 | | 9/2008 | Mattar | |

* cited by examiner

*Primary Examiner* — Jack W Lavinder
*Assistant Examiner* — Abigail E Morrell
(74) *Attorney, Agent, or Firm* — Milord A. Keshishian

(57) ABSTRACT

A setting that includes a plurality of ribs with beveled sides that divide the setting into a plurality of contiguous compartments. Posts having a first height from a top-side of the ribs, and split at a top-ends to form prongs that are bent onto a stone that is set within an adjacent compartment, securing the stone. The first height accommodates a top-section of the stone enabling setting of various cut configurations, and the beveled sides of the ribs accommodate a lower-section of the stone.

13 Claims, 15 Drawing Sheets

JEWELRY SETTING

CROSS-REFERENCE TO RELATED APPLICATIONS

None.

BACKGROUND OF THE INVENTION

1. Field of the Invention

The present invention relates to the field of jewelry settings and, more particularly, to the field of jewelry settings for mounting jewelry, where the setting is substantially invisible.

2. Description of Related Art

Diamonds and other gemstones are frequently mounted in various ways to produce different optical impressions and different optical effects. For example, one popular type of mounting includes an invisible setting, namely a setting that is not visible from the outer face of the gemstone. Invisible settings are particularly used when a plurality of such gemstones are mounted contiguously to each other to create the appearance of a single large gemstone. Many invisible settings have been devised for this purpose. The typical invisible settings in use today generally include prongs or the like received in grooves or notches formed in the pavilion of each gemstone so as to mount the gemstone with the crown facing outwardly, with the pavilion facing inwardly, and with the prongs concealed by the girdle.

Invisible settings often require the use of stones of substantial size so to enable the forming of the grooves or notches in the pavilion of each stone, which, obviously, make the article of jewelry more costly. It should be noted that the groove cut might weaken the stone, making the stone liable to breaking, hence one reason for the use of larger size stones. Determining the placement (position) of the groove is complex because if the groove is positioned too high on the pavilion, it weakens the stone, and if the groove is too low, then the setting will show (no longer an invisible setting). Further, the groove cut "tortures" the stone because it uses metal blade that turns at very high revolutions per minute, generating a high level of heat, which may cause the stone to lose its luster. In addition, labor required for the formation of the grooves in the pavilion of each stone adds additional labor costs to the entire manufacturing process. Finally, most invisible settings are made specific to a specific gemstone cut such as, for example, the princess cut, which is limiting.

Accordingly, in light of the current state of the art and the drawbacks to current settings mentioned above, a need exists for an invisible stone setting that would not require a large sized stone, would not add substantial labor costs to the entire setting process, and would allow for setting of any shaped gemstone cut.

BRIEF SUMMARY OF THE INVENTION

The present invention provides a stone assembly, comprising a setting that includes a plurality of ribs with beveled sides that divide the setting into a plurality of contiguous compartments. Further, the present invention provides posts having a first height from a top-side of the ribs, and split at a top-ends to form prongs that are bent onto a stone that is set within an adjacent compartment of the plurality of compartments, thereby securing the stone. The first height accommodates a top-section of the stone enabling setting of various cut configurations, and the beveled sides of the ribs accommodate a lower-section of the stone.

One exemplary optional aspect of the present invention provides a stone assembly, wherein the beveled sides of the ribs of the plurality of compartments form a top-opening that is wider than a bottom-opening, forming a syncline to accommodate a pavilion section of a stone.

Another exemplary optional aspect of the present invention provides a stone assembly, wherein the ribs are comprised of trunk section with decreasing thickness from a lower trunk section towards the top-side of the ribs, forming the beveled sides.

Yet another exemplary optional aspect of the present invention provides a stone assembly, wherein the top-side of the ribs is substantially flat, having a length and a width, enabling setting of a girdle section of the stone on the flat section of the ribs.

Still another exemplary optional aspect of the present invention provides a stone assembly, wherein the top-side of the ribs is of reverse V-configuration with two opposed faces converging to form a substantially sharp outer edge.

A further exemplary optional aspect of the present invention provides a stone assembly, wherein the posts are split along an orientation that follows rib-orientations, forming prongs adjacent a respective compartment.

Still a further exemplary optional aspect of the present invention provides a stone assembly, wherein the posts are split along an orientation that follows rib-orientations, forming prongs adjacent a respective compartment, with the prongs having a pre-cut notch along the first height with the stone secured against the pre-cut notch and set within the compartment.

Another exemplary optional aspect of the present invention provides a stone assembly, wherein the posts are split along an orientation that is aligned substantially parallel with rib-orientation of the ribs, and the prongs formed are bent towards adjacent respective compartments, onto a pre-cut section of the stone set within the adjacent respective compartment.

Yet another exemplary optional aspect of the present invention provides a stone assembly, wherein the prongs are substantially configured as one of two and four leaf clover, which are polished, providing a substantially perceived invisible setting.

Still another exemplary optional aspect of the present invention provides a stone assembly, wherein the compartment has a substantially rhomboid configuration.

Further exemplary optional aspect of the present invention provides a stone assembly, wherein the compartment of the plurality of compartments has a polygonal configuration.

Still further exemplary optional aspect of the present invention provides a stone assembly, wherein the compartment of the plurality of compartments has a circular configuration.

Another exemplary optional aspect of the present invention provides a stone assembly, wherein the setting includes a base.

Another exemplary aspect of the present invention provides a method for setting gemstones, comprising:

- dividing a setting into a plurality of contiguous compartments by a plurality of ribs with beveled sides;
- protruding a section of the plurality of the ribs to form posts;
- dividing a top of the posts to form prongs;
- positioning a pre-cut stone within an adjacent compartment of the prongs; and
- bending the prongs onto a pre-cut section of a set stone for securing the stone.

Such stated advantages of the invention are only examples and should not be construed as limiting the present invention. These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character(s) present corresponding part(s) throughout.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

Figure 1:
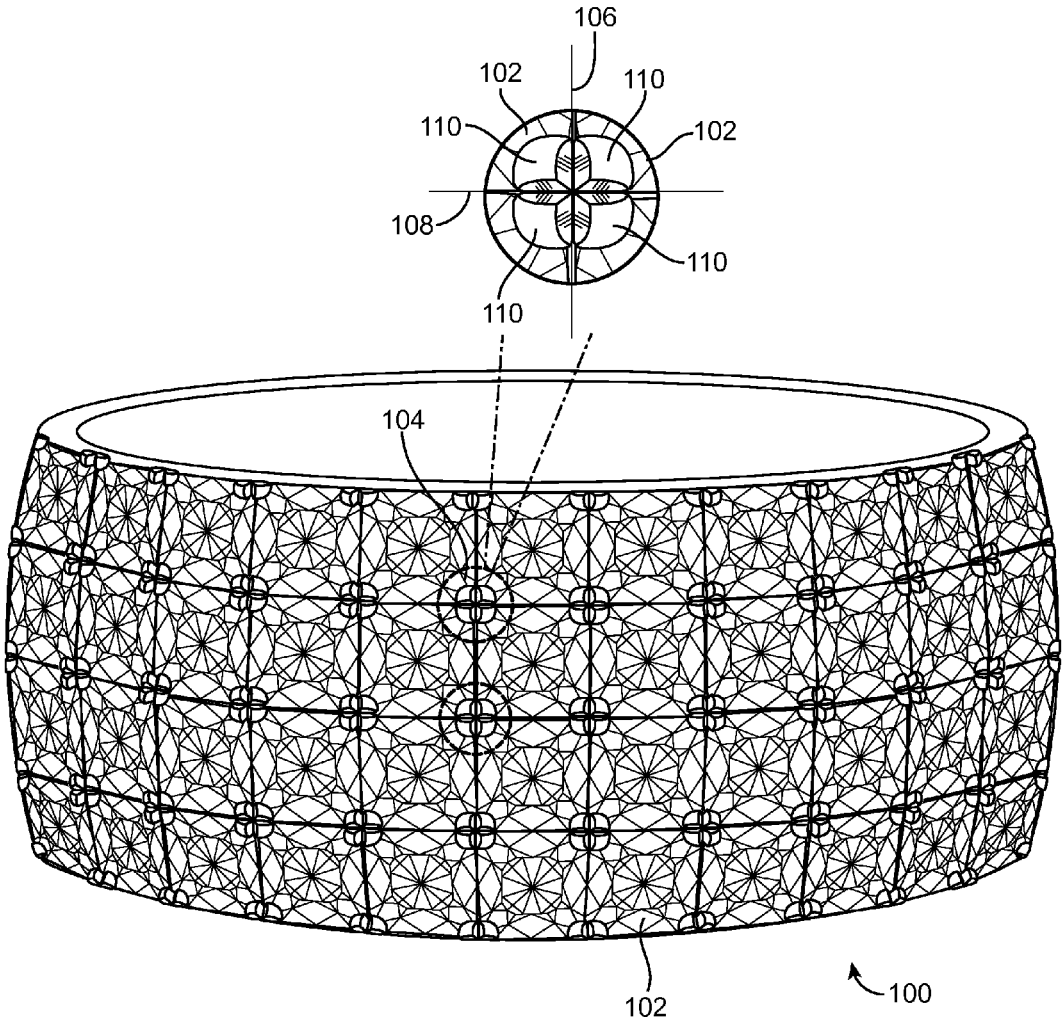
FIG. 1 is an exemplary perspective illustration of a completely assembled article of jewelry, using a setting system in accordance with the present invention.

FIG. 1 is an exemplary perspective illustration of an article of jewelry 100 using a mounting system in accordance with the present invention that produces an optical impression and an optical effect that creates an invisible setting for a plurality of gemstones 102 used, producing an appearance of a single large gemstone. As illustrated in the enlargement section 104 of FIG. 1, the present invention uses a set of prongs 110, that are polished and bent over the top of the gemstones 102 to secure each gemstone 102 within a compartment. That is, the prongs 110 may substantially be configured as an exemplary two or four protruding members, which are bent over the top of the gemstones 102, providing a substantially perceived invisible setting, with invisible spacing along split lines 106 and 108. It should be noted that if lustrous gemstones are used, the protruding members may be polished (or cleaned) to look and match the luster of the stones, thereby perceived as invisible. As illustrated, the shine of the prongs makes the setting look invisible. The mounting system in accordance with the present invention provides an invisible stone setting manufacturing technique that does not require the use of large sized gemstones because the gemstones need not be cut at their pavilion and as a result, saving substantial costs in terms of parts and specialized labor. Further, the present invention provides an invisible stone setting manufacturing technique that allows for setting of any shaped gemstone cut.

FIGS. 2A to 2F are exemplary perspective illustrations of another article of jewelry 200 using the setting system of the present invention. The stone assembly of the article of jewelry 200 is comprised of a setting 202 (that may include a base) that includes a plurality of ribs 208 with beveled sides 212 that divide the setting 202 into a plurality of contiguous compartments 204. The number of contiguous compartments 204 is determined by the user, but it could be as few as one compartment 204 in one preferred embodiment. As illustrated, the compartments 204 of the setting 202 exemplarily have a substantially rhomboid configuration. Further included in the setting 202 are posts 206 having a first height 218 from a top-side 210 of the ribs 208, and split along lines 106 and 108 at the top to form prongs 110 that are bent (along the direction of the indicated arrows referenced 224) onto the gemstone 102 that is set within an adjacent compartment 204, securing the gemstone 102. That is, in this particular, non-limiting exemplary instance, the prongs 110 are substantially configured as one of two and four leaf clover, which are polished, and bent over the top of the gemstones 102, providing a perceived invisible setting, with invisible spacing along the split lines 106 and 108. The first height 218 accommodates a top-section of the gemstone 102 enabling setting of various cut configurations, and the beveled sides 212 of the ribs 208 accommodate a lower-section of the gemstone.

As further illustrated in FIGS. 2A to 2F, the posts 206 are preferably split along an orientation that follows rib-orientations 216, forming prongs 110 adjacent a respective compartment 204, which, in turn, aligns with the periphery 230 of the gemstones 102, making the entire setting 202 invisible. In other words, the posts 206 are preferably split along an orientation that is aligned substantially parallel with rib-orientation 216 of the ribs 208, and the prongs formed are bent towards adjacent respective compartments 204, onto a pre-cut section 232 of the stone 102 set within the adjacent respective compartment 204. In this particular exemplary instance, the orientation of the split lines 106 and 108 are at a diagonal, starting from a corner of the post 206 and ending at an opposite corner.

As illustrated in FIGS. 2A to 2F, the gemstones 102 are cut at the corner sections 232 where the prongs 110 are bent to rest and secure the gemstones 102. Accordingly, a groove below the girdle or above the pavilion is no longer required to set the gemstone 102, making the entire process much less labor intensive. In addition, given that there is no groove on the gemstone 102, there is no need for alignment of the gemstone (along the groove thereof) with the prongs to slide the gemstone 102 into a compartment 204. This makes the actual physical positioning (mounting) of the gemstone 102 of the present invention onto the setting 202 much less labor intensive. Further, given that the cut 232 of the present invention is not a groove, and is a simple, small corner cut, a smaller size gemstone may be used, making the entire article of jewelry 200 much more affordable. Additionally, it is much easier and less labor intensive in terms of skilled cutters to cut the gemstones at corners than provide a groove at the pavilion of the stone.

As further illustrated, the beveled sides 212 of the ribs 208 of the plurality of compartments 204 form a top-opening 250 that is wider than a bottom-opening 252, forming a syncline to accommodate a pavilion section of the gemstone 102. This prevents the gemstone 102 from slipping out form the bottom opening 252. The syncline configuration of the beveled sides 212 of the ribs 208 also prevent the gemstone 102 from shifting or moving within the compartment 204, providing a tight-snug, secure fit for the gemstones 102. The ribs 208 are comprised of a trunk section with decreasing thickness from a lower trunk section towards the top-side 210 of the ribs 208, which form the beveled sides 212. As illustrated in this embodiment, the top-side 210 of the ribs 208 is of reverse V-configuration with two opposed faces (beveled sides 212) converging at top 210 to form a substantially sharp outer edge.

Figure 2A:
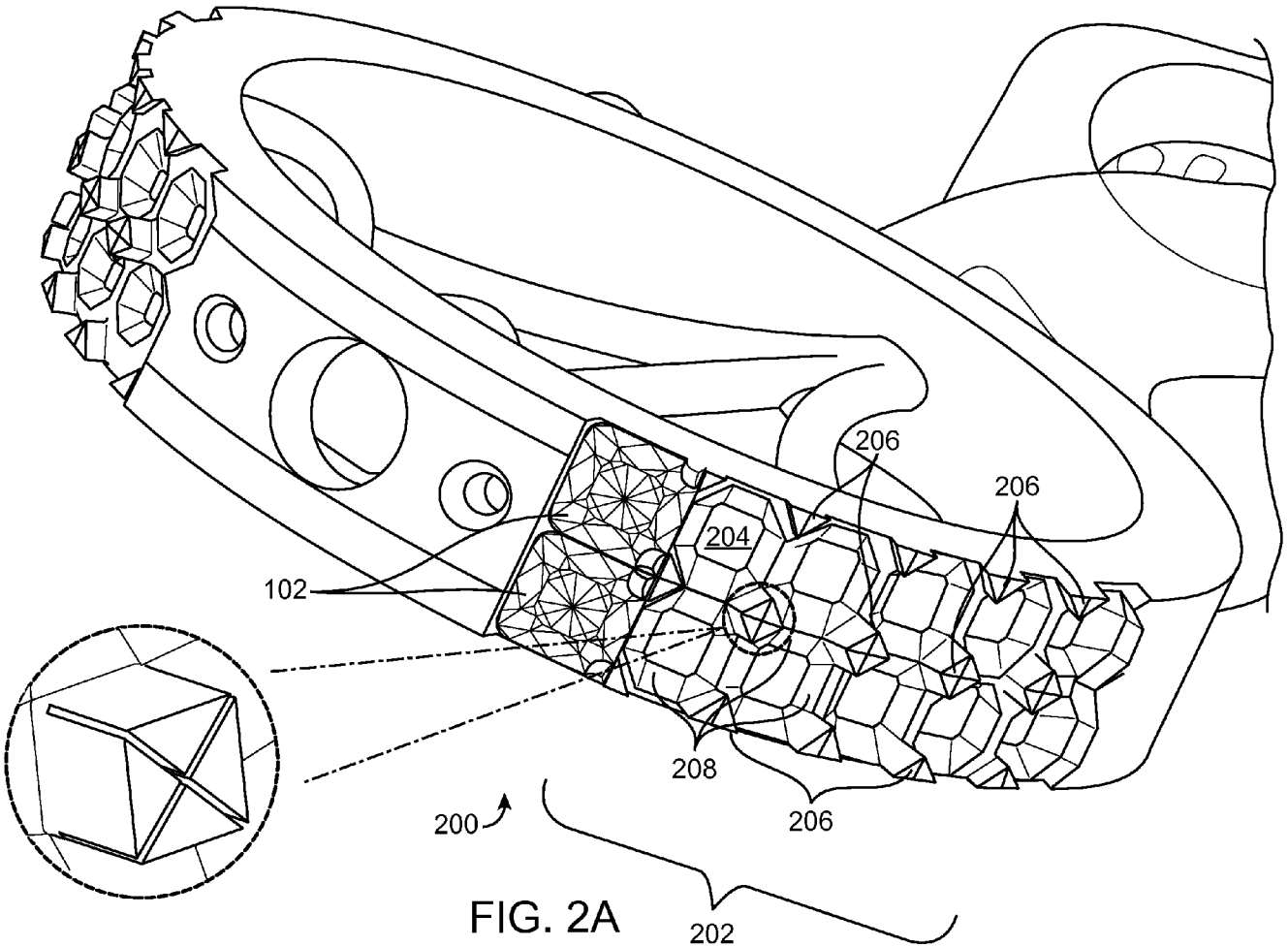
FIGS. 2A to 2F are exemplary perspective illustrations of another article of jewelry illustrating the setting and mounting of gemstones in accordance with the present invention.
Figure 2B:
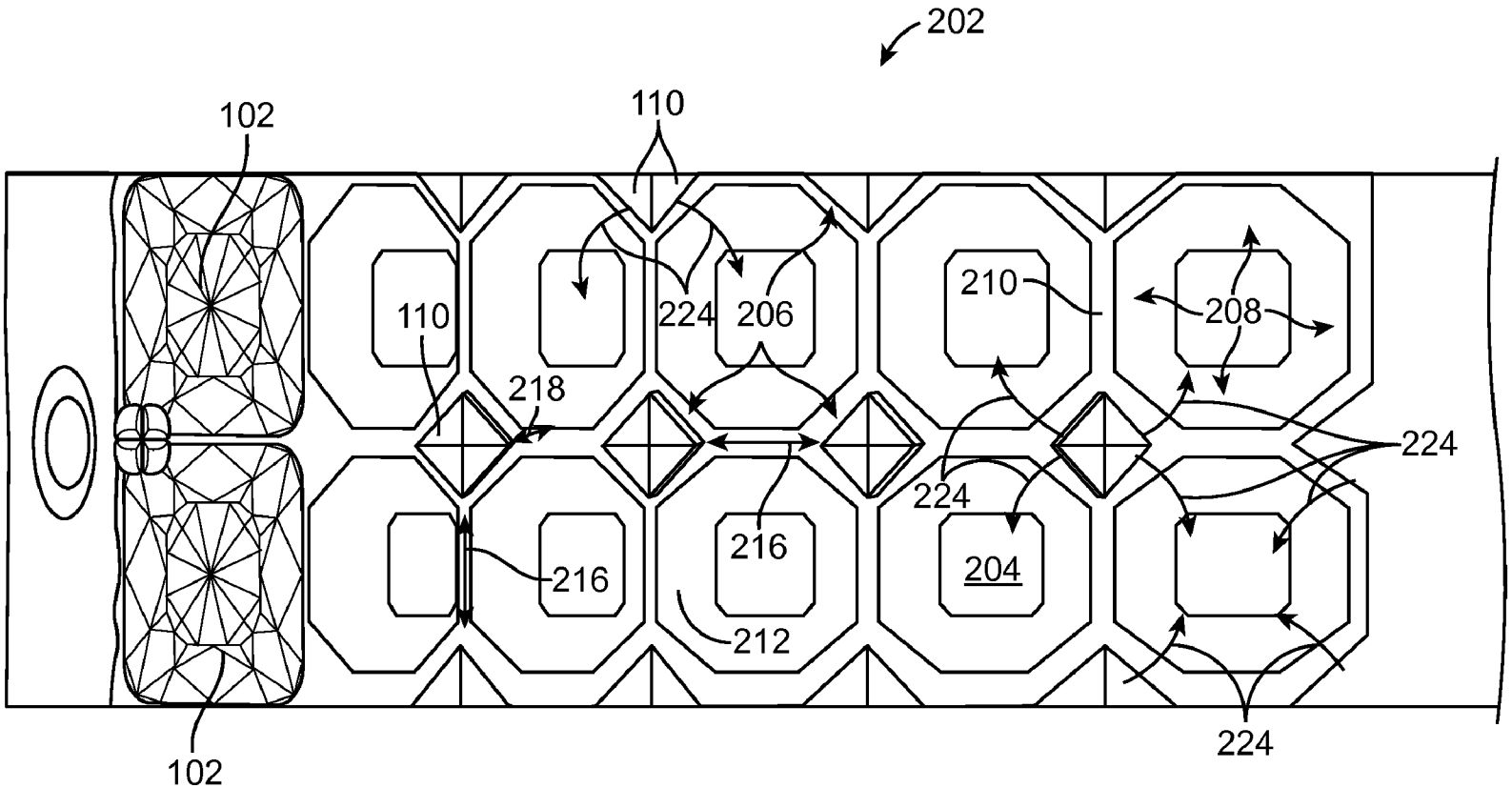
Figure 2C:
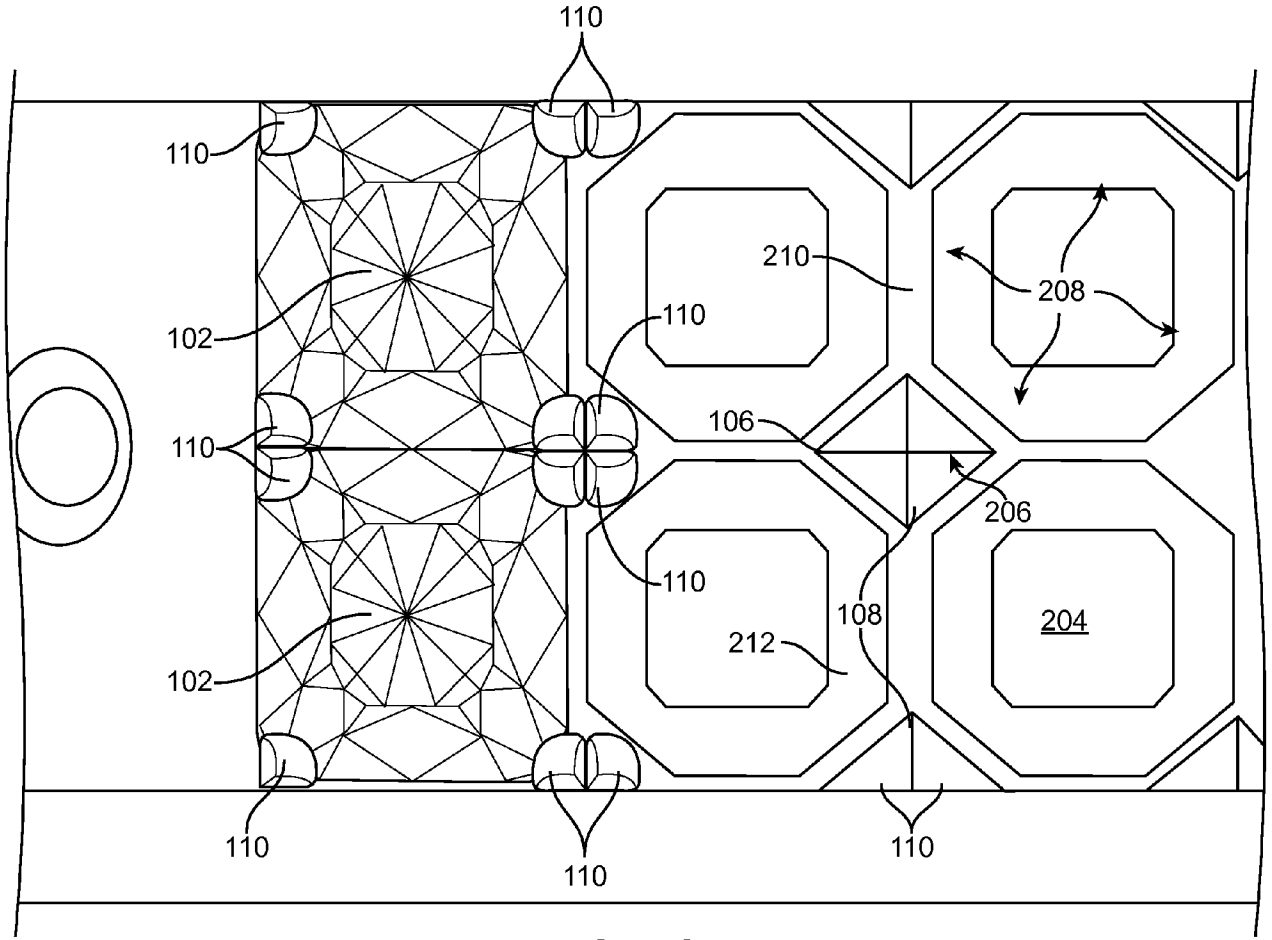
Figure 2D:
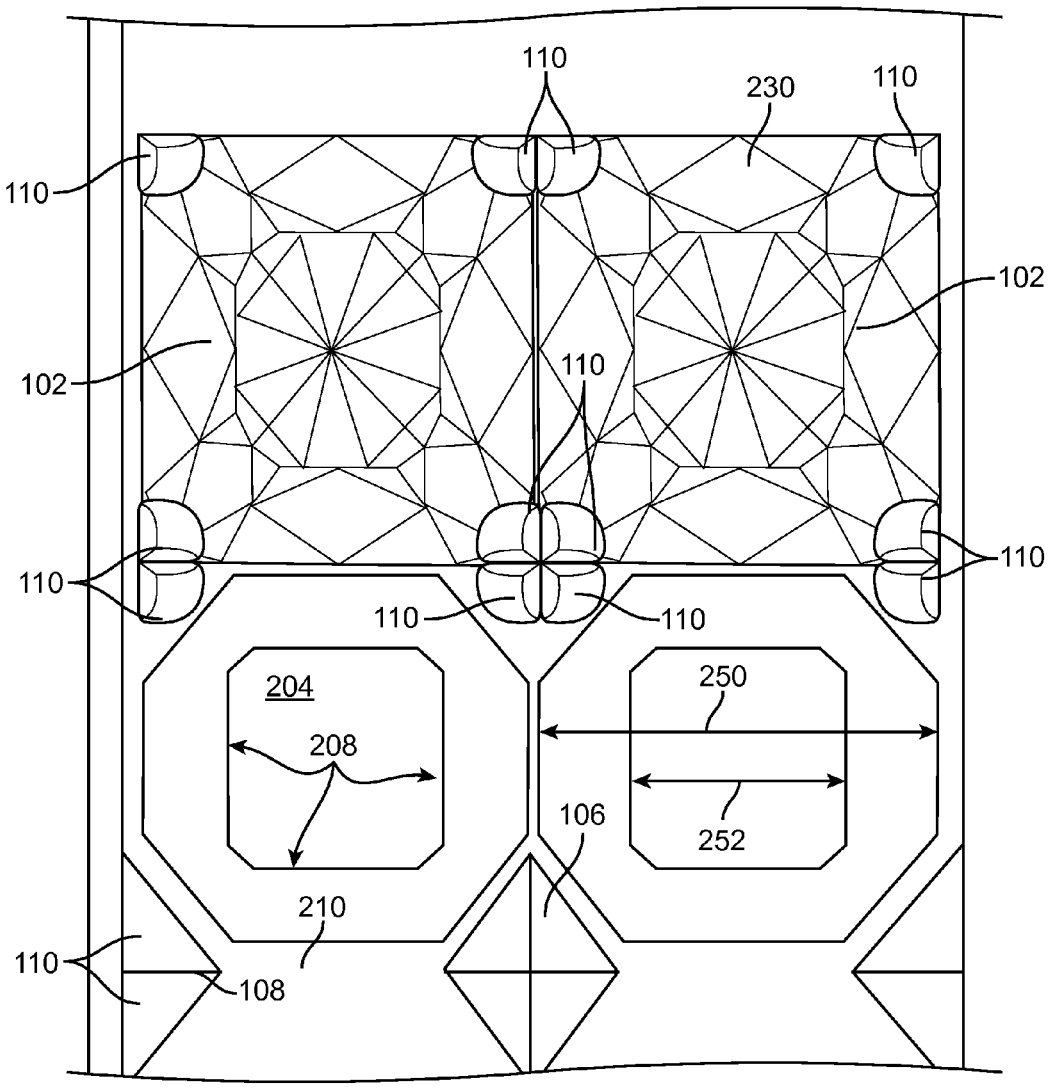
Figure 2E:
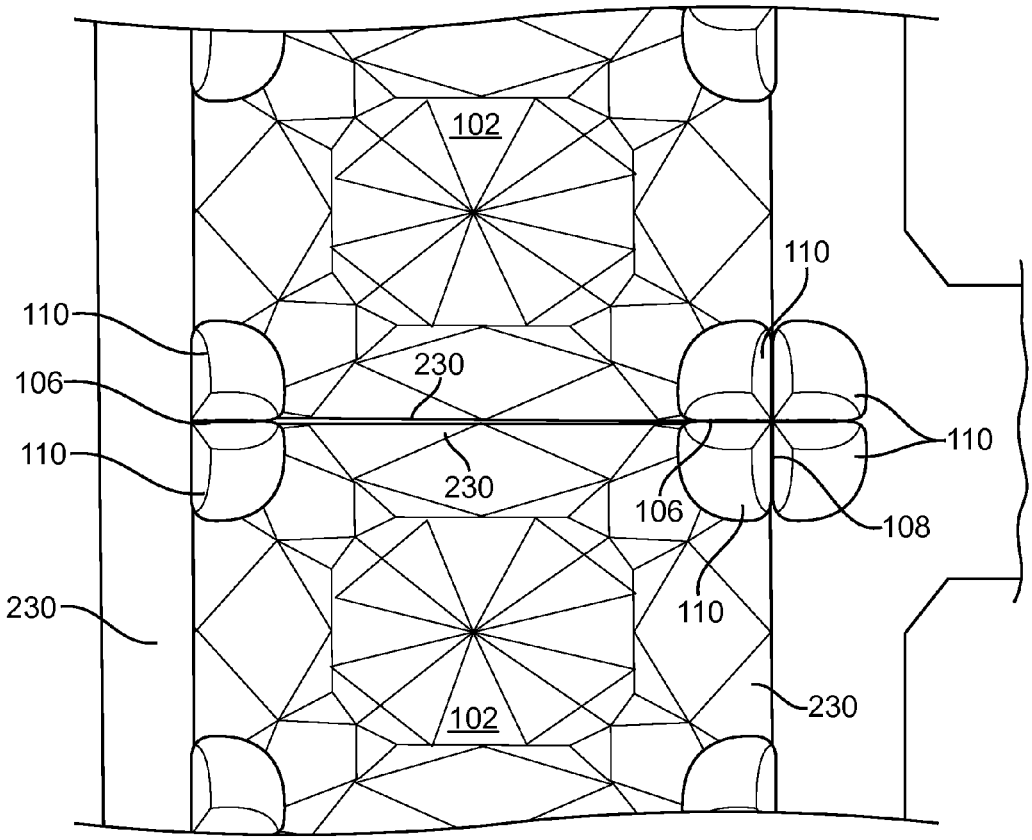
Figure 2F:
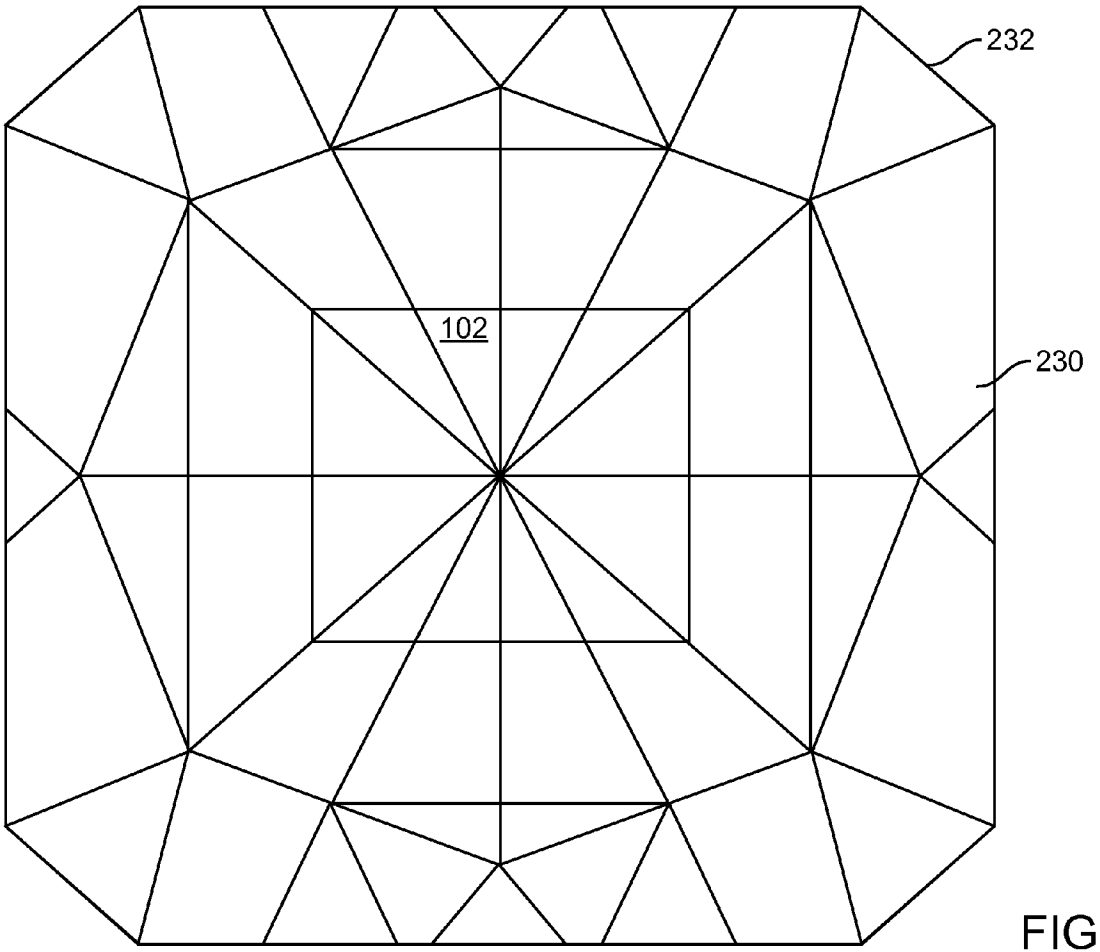
Figure 3A:
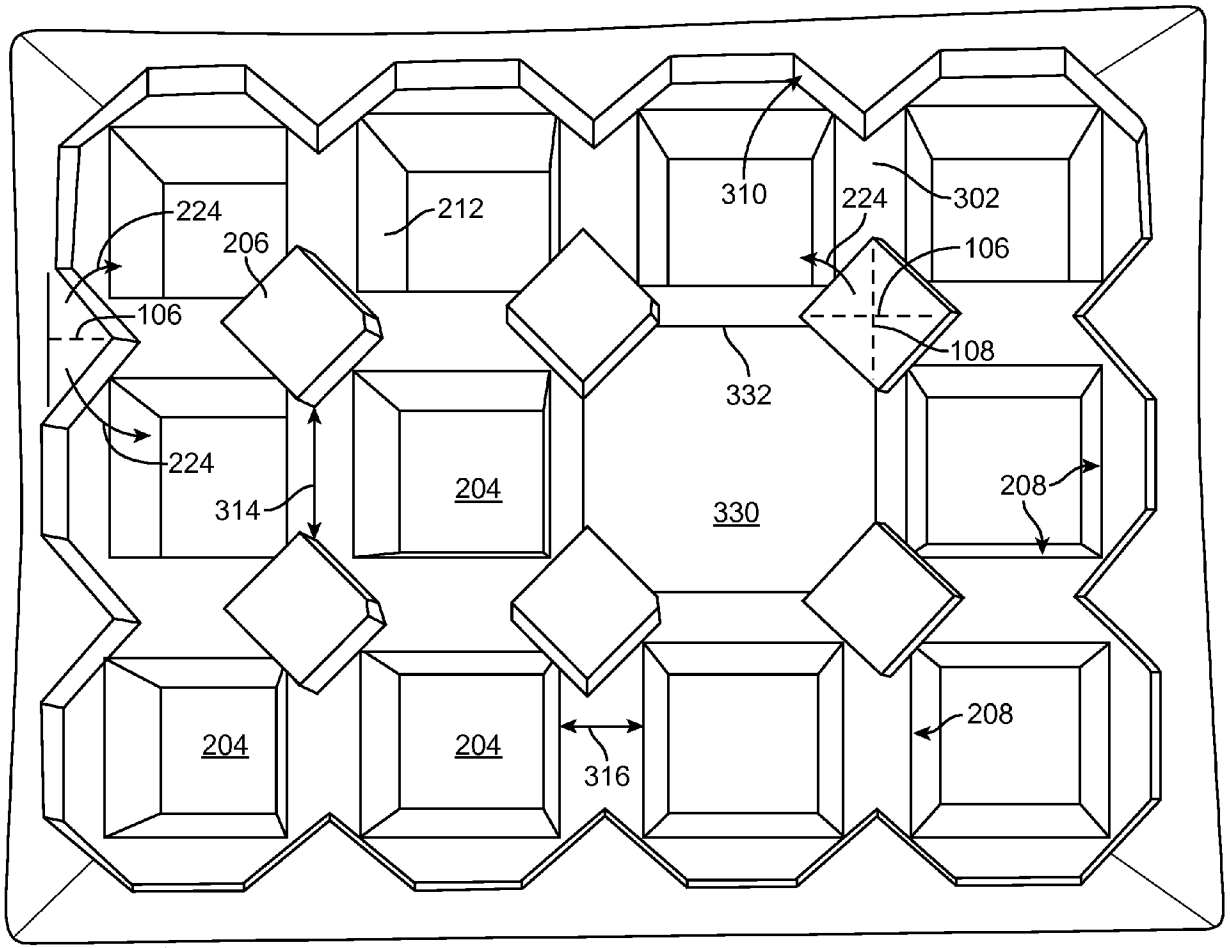
FIGS. 3A to 3C are exemplary illustrations of another setting in accordance with the present invention.
Figure 3B:
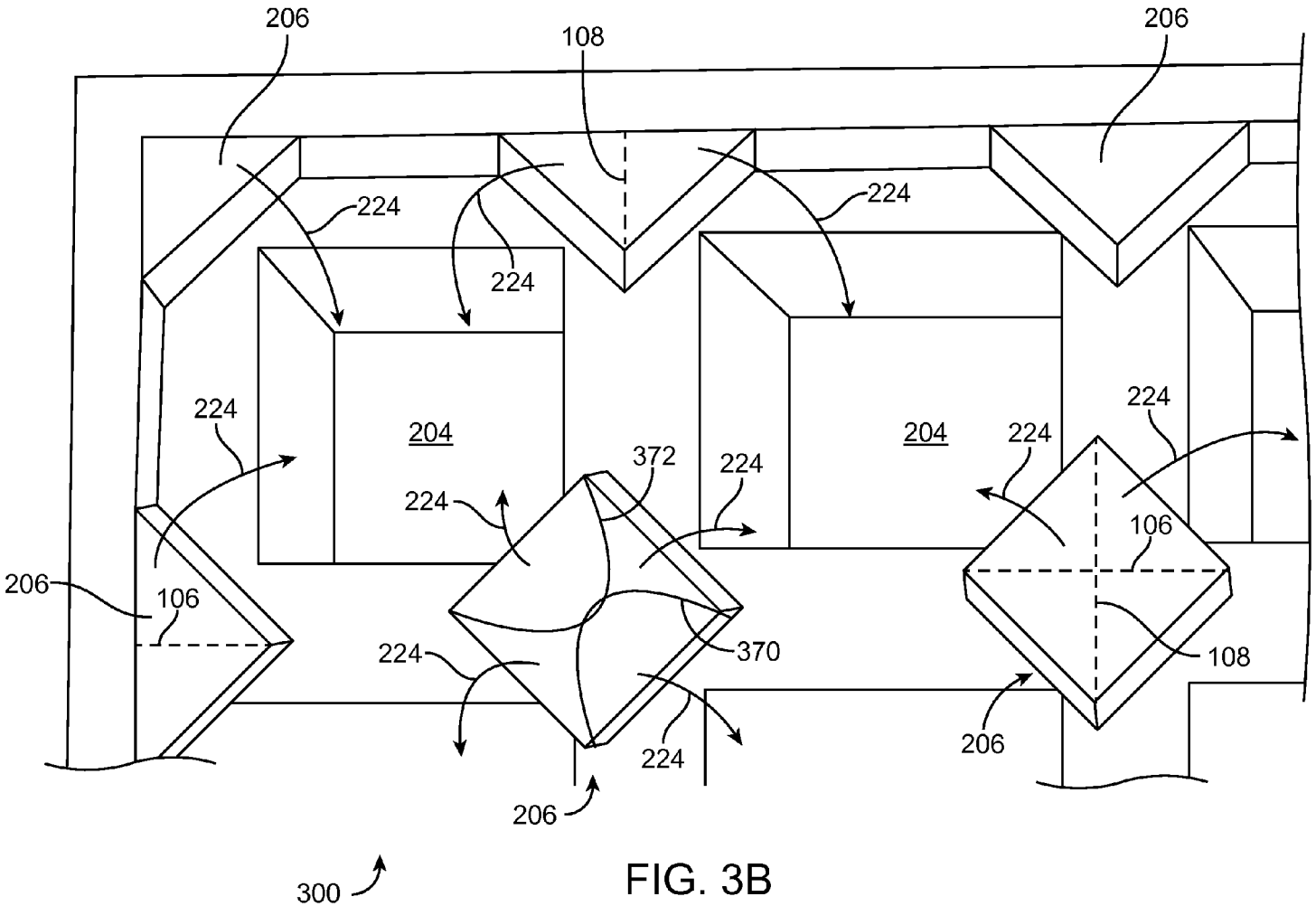
Figure 3C:
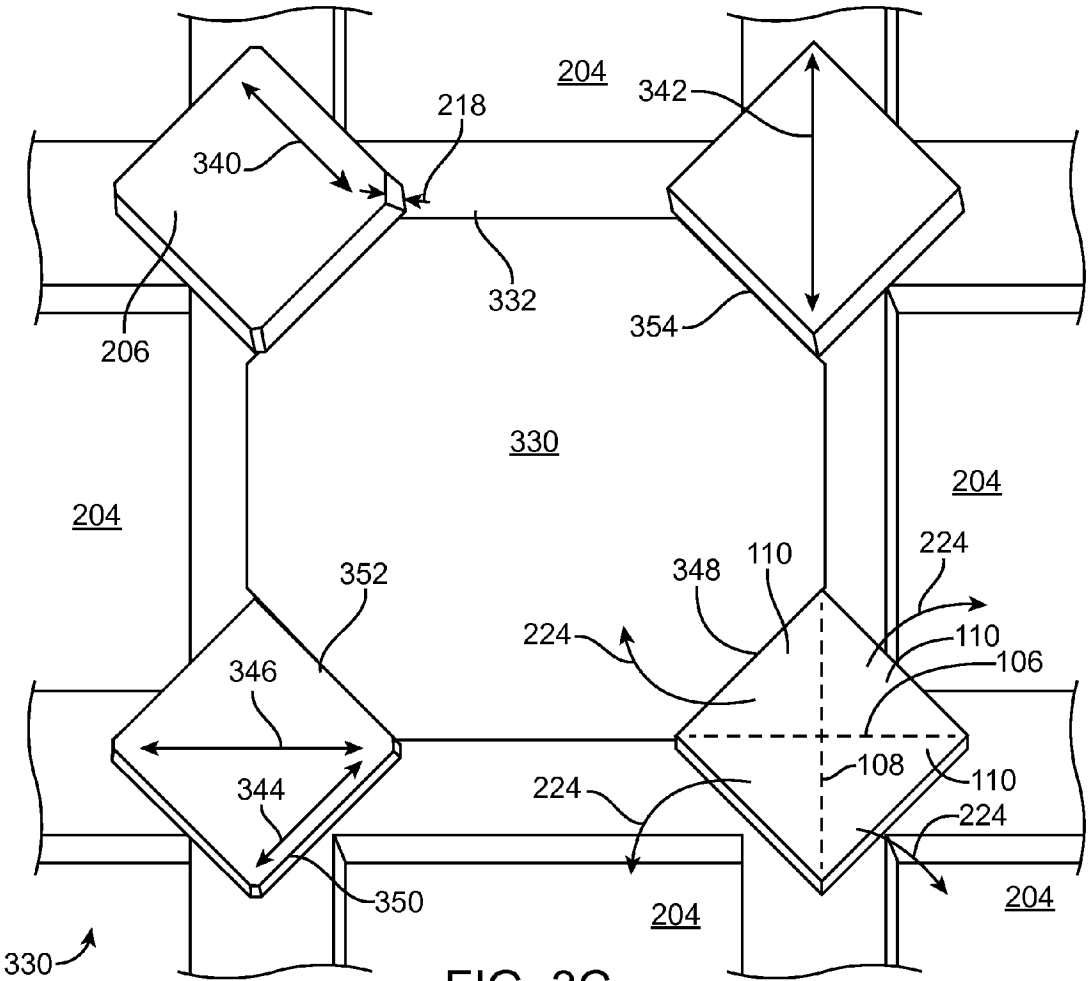

FIGS. 3A to 3C are exemplary illustrations of a setting 300 used in accordance with the present invention. The setting 300 includes similar corresponding or equivalent components and or interconnections as the setting 100 and 200 that are shown in FIGS. 1 to 2F, and described above. Therefore, for the sake of brevity, clarity, convenience, and to avoid duplication, the general description of FIGS. 3A to 3C will not repeat every corresponding or equivalent component and or interconnections that has already been described above in relation to settings 100 and 200 that are shown in FIGS. 1 to 2F.

As illustrated in FIGS. 3A to 3C, the top-side 302 of the ribs 208 is substantially flat, having a length 314 and a width 316, enabling setting of a girdle section of the gemstone 102 onto the flat section 302 of the ribs 208. The compartments 204 of the setting 300 may have any polygonal configuration with walls 310, but may also be configured as circular. In addition, the split lines 106 and 108 need not be along the orientation that follows rib-orientations 216, but by may comprise of curved splits 370 and 372 (FIG. 3B) that enable the posts 206 to form prongs 110 adjacent a compartment 204. This enables the resulting formed prongs 110 to bend towards the adjacent compartment 204 in the direction of the indicated arrows 224. However, it is preferred if the split lines follow the rib-orientations 216 (which are associated with the orientation of the periphery of the gemstones 102) for invisible settings. As best illustrated in FIG. 3C, the dimensions of the posts 206 may vary according to design and hence, the height 218, width 340, length 344, and diagonal lengths 342 and 346 may vary, making the prong 110 dimensions variable, including post sides 348, 350, 352, and 354. In this embodiment, the orientation of the sides 348, 350, 352, and 354 of the posts 206 are at a diagonal relation to the rib-orientations 216.

Figure 4A:
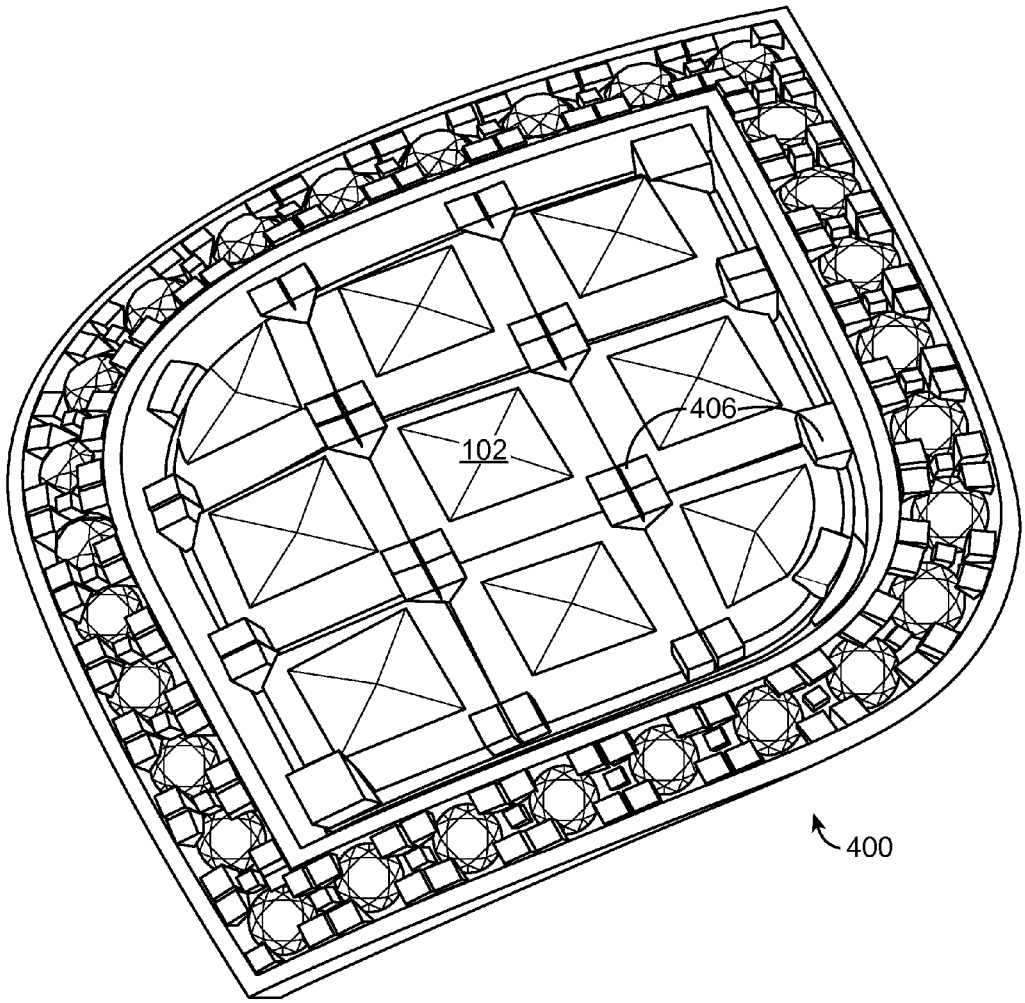
FIGS. 4A to 4B are exemplary illustrations of a fully assembled article of jewelry and setting in accordance with the present invention.
Figure 4B:
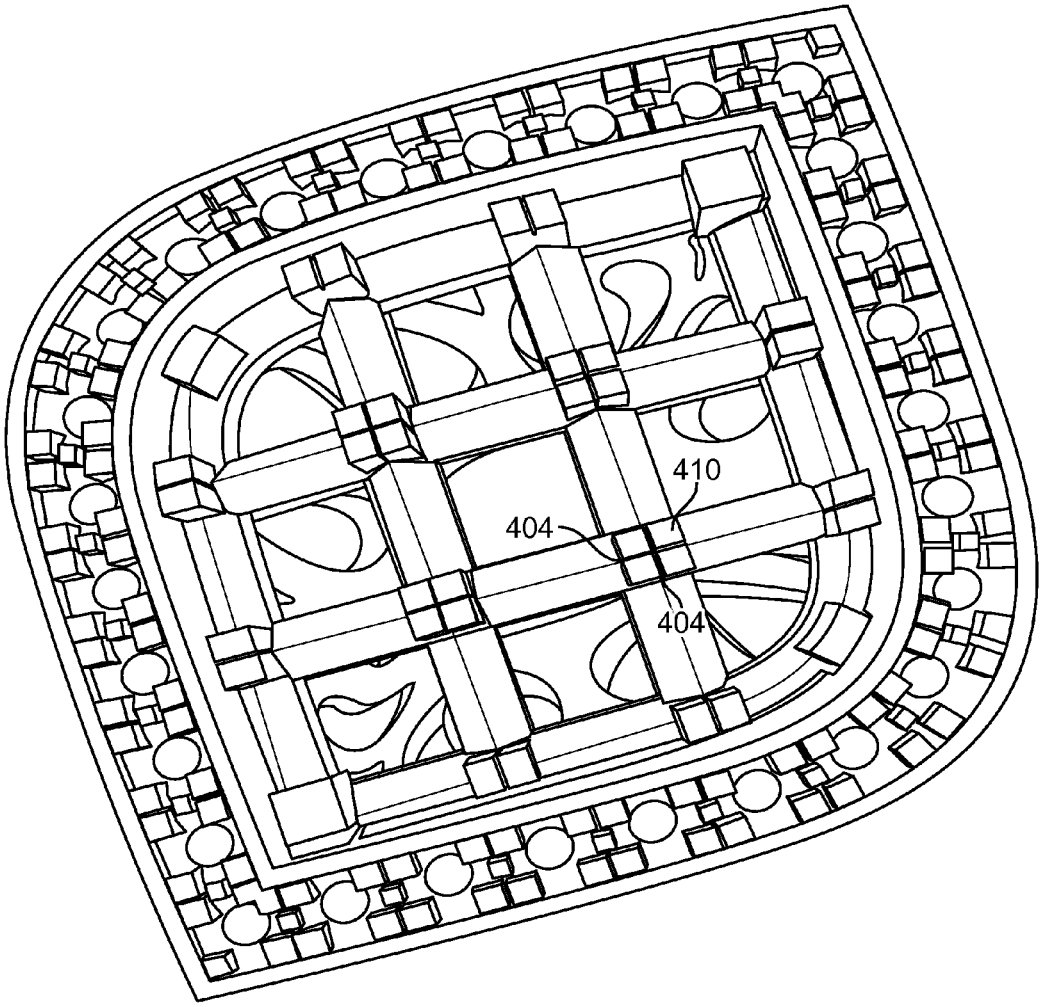

FIGS. 4A to 4B are exemplary illustrations of a setting 400 used in accordance with the present invention. The setting 400 includes similar corresponding or equivalent components and or interconnections as the setting 100, 200, and 300 that are shown in FIGS. 1 to 3C, as described above. Therefore, for the sake of brevity, clarity, convenience, and to avoid duplication, the general description of FIGS. 4A to 4B will not repeat every corresponding or equivalent component and or interconnections that has already been described above in relation to settings 100, 200, and 300 that are shown in FIGS. 1 to 3C.

As illustrated in FIGS. 4A and 4B, the orientation of the sides 410 of the posts 406 is different, requiring the split lines 402 and 404 to start and end from the center of one side 410 to the center of the opposite side 410 of the post 406. In other words, the sides 410 of the posts 406 are oriented or aligned in parallel with rib-orientations 216 and hence, requiring the orientations of the split lines 402 and 404 as described, in order for orientation of the split lines 402 and 406 to continue to be parallel or aligned with the rib-orientations 216.

Figure 5A:
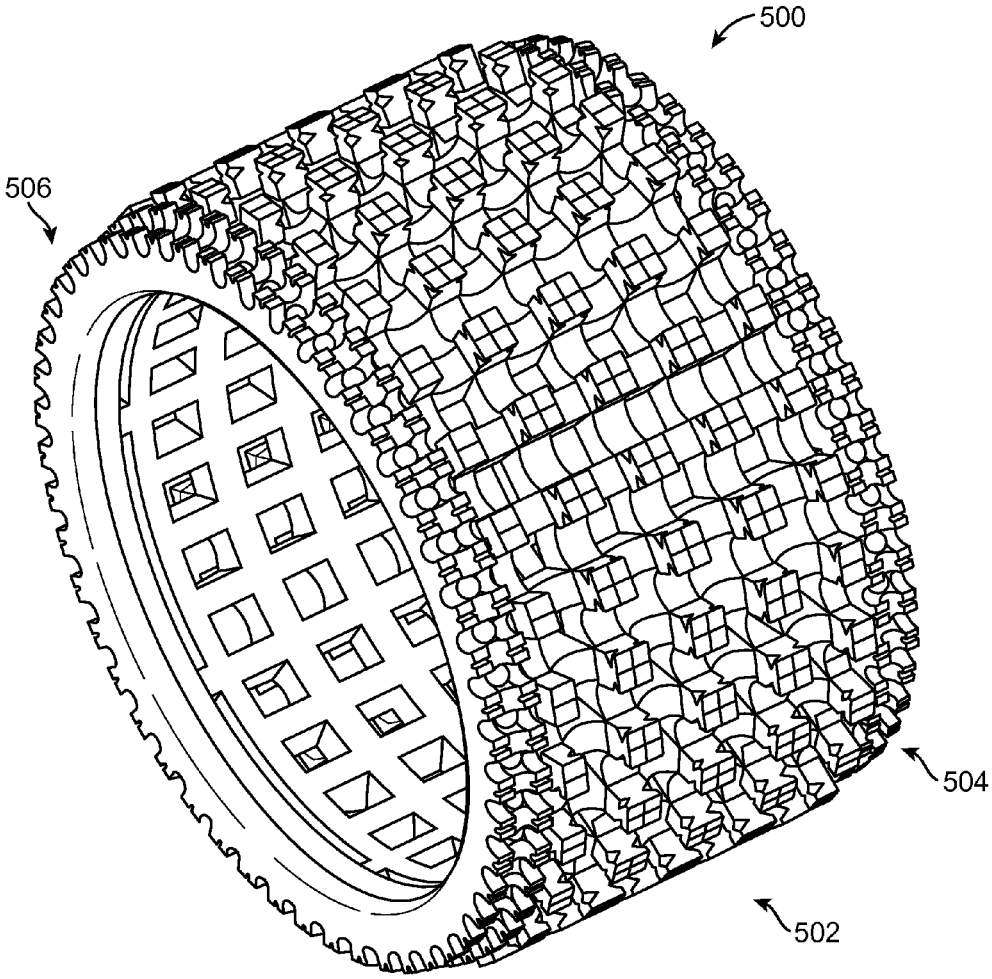
FIGS. 5A to 5B are exemplary illustrations of another setting in accordance with the present invention.
Figure 5B:
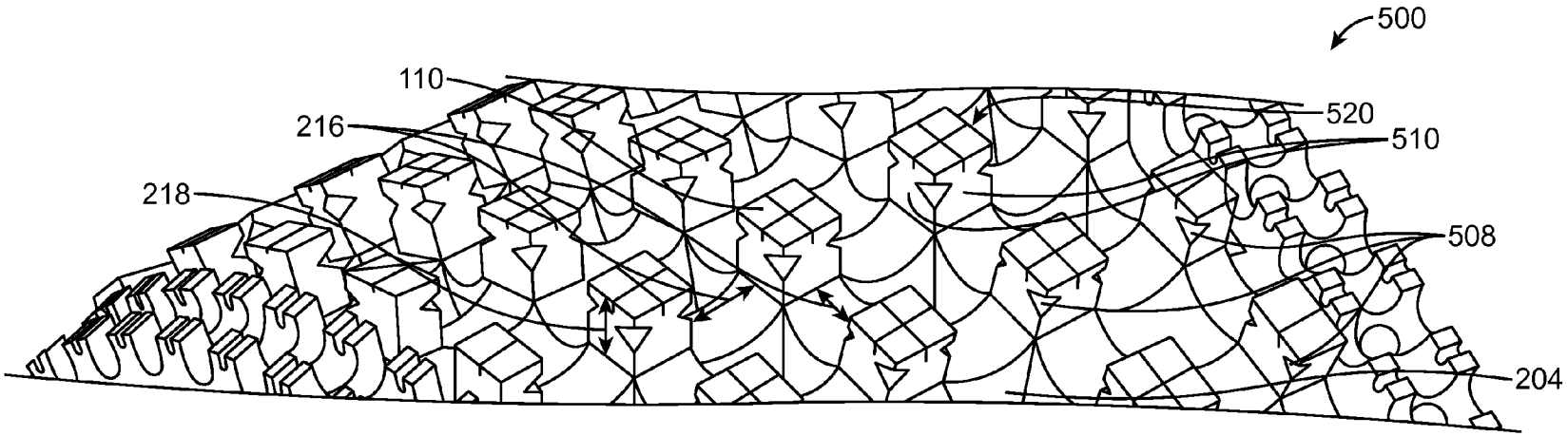
Figure 6A:
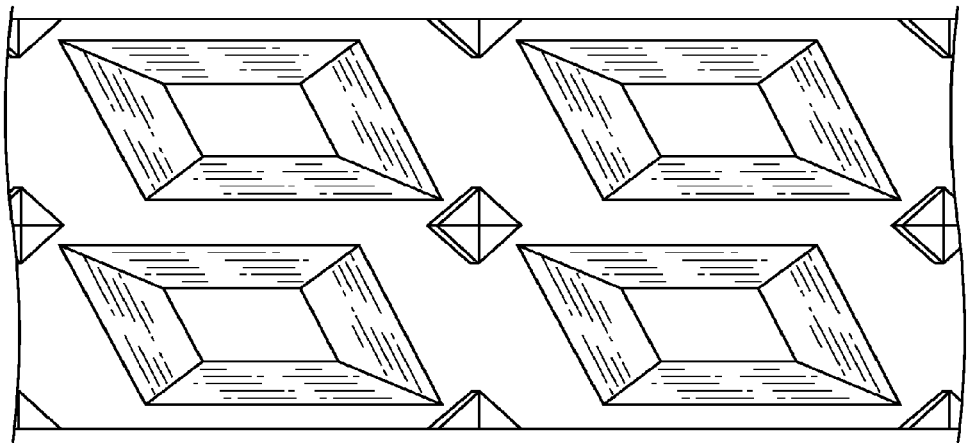
FIG. 6A and 6B are exemplary illustrations of rhomboid and circular compartment configurations in accordance with the present invention.
Figure 6B:
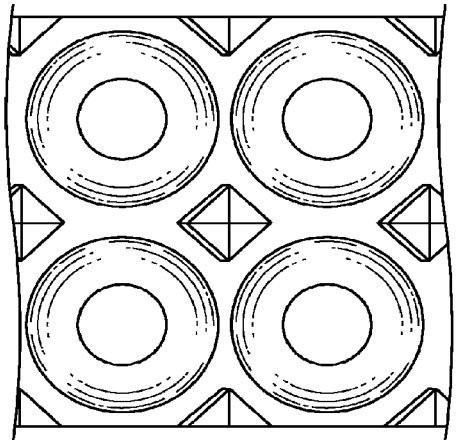

FIGS. 5A to 5B are exemplary illustrations of a setting 500 used in accordance with the present invention. The setting 500 includes similar corresponding or equivalent components and or interconnections as the setting 100, 200, 300, and 400 that are shown in FIGS. 1 to 4B, and described above. Therefore, for the sake of brevity, clarity, convenience, and to avoid duplication, the general description of FIGS. 5A to 5B will not repeat every corresponding or equivalent component and or interconnections that has already been described above in relation to settings 100, 200, 300, and 400 that are shown in FIGS. 1 to 4B.

As illustrated in FIGS. 5A and 5B, the article of jewelry 500 includes three varying size settings 502, 504, and 506, with the posts 520 that are split along an orientation that follows rib-orientations 216. This forms prongs 110 adjacent a respective compartment 204, with the prongs 110 having a pre-cut notch 508 along the first height 218 with the gemstone secured against the pre-cut notch 508 and set within the compartment 204.

Although the invention has been described in considerable detail in language specific to structural features and or method acts, it is to be understood that the invention defined in the appended claims is not necessarily limited to the specific features or acts described. Rather, the specific features and acts are disclosed as preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. For example, the compartments may be configured as polygonal or have any shape, including circular configuration. Accordingly, compartments may be commensurately configured to accommodate any particular gemstone size, shape, and cut. The orientation of the posts and their outer perimeter (i.e., transverse cross-section) thereof may be of any configuration and shape, including polygonal, circular, or any others (such as cylindrical posts). Further, the posts (including their configuration and orientation) need not be uniform throughout the setting. That is, a post in a setting may have a rectangular cross-section, and another post in the same setting may comprise of a circular cross-section. The splitting of the posts into prongs need not be along straight lines as illustrated, so long as the split defines a prong that can be bent towards the nearest adjacent compartment to secure the gemstone. That is, the defined prong can have quarter arch configurations at the split, rather than two sides (as a result of the post being split in four ways). Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A stone assembly, comprising:

a setting that includes:

a plurality of ribs with beveled sides that divide the setting into a plurality of contiguous compartments;

posts having a first height from a top-side of the ribs;

the posts are substantially diagonally split at a top-end commencing from a vertex of a corner of the posts to form prongs to secure a stone that is set within an adjacent compartment of the plurality of compartments;

the posts are split along an orientation that substantially follows rib-orientation, and the prongs formed are bent towards adjacent respective compartments and onto a pre-cut section of the stone set within the adjacent respective compartment;

the first height accommodates a top-section of the stone enabling setting of various cut configurations, and the beveled sides of the ribs accommodate a lower-section of the stone.

2. The stone assembly as set forth in claim 1, wherein:

the beveled sides of the ribs of the plurality of compartments form a top-opening that is wider than a bottom-opening, forming a syncline to accommodate the pavilion section of the stone.

3. The stone assembly as set forth in claim 1, wherein:

the ribs are comprised of trunk section with decreasing thickness from a lower trunk section towards the top-side of the ribs, forming the beveled sides.

4. The stone assembly as set forth in claim 3, wherein:

the top-side of the ribs is substantially flat, having a length and a width to set the girdle section of the stone on the flat section of the ribs.

5. The stone assembly as set forth in claim 3, wherein:

the top-side of the ribs is of reverse V-configuration with two opposed faces converging to form a substantially sharp outer edge.

6. The stone assembly as set forth in claim 1, wherein:

the prongs having a pre-cut notch along the first height with the stone secured against the pre-cut notch and set within the compartment.

7. The stone assembly as set forth in claim 1, wherein:

the prongs are configured as one, two, or four members that are substantially inconspicuous and indistinguishable from the set stone.

8. The stone assembly as set forth in claim 1, wherein:

the compartment has a substantially rhomboid configuration.

9. The stone assembly as set forth in claim 1, wherein:

the compartment of the plurality of compartments has a polygonal configuration.

10. The stone assembly as set forth in claim 1, wherein:

the compartment of the plurality of compartments has a circular configuration.

11. The stone assembly as set forth in claim 1, wherein:

the setting includes a base.

12. A method for setting gemstones, comprising:

dividing a setting into a plurality of contiguous compartments by a plurality of ribs with beveled sides;

protruding a section of the plurality of the ribs to form posts;

dividing a top of the posts diagonally, commencing from a vertex of a corner of the posts to form prongs;

positioning a pre-cut stone, within an adjacent compartment of the prongs; and bending the prongs onto a pre-cut section of the pre-cut stone for securing the pre-cut stone.

13. The method for setting gemstones, as set forth in claim 12, further comprising:

modifying a luster of the setting commensurate with that of the gemstone.

* * * * *